United States Patent [19]

Goldfarb

[11] Patent Number: 4,496,155

[45] Date of Patent: Jan. 29, 1985

[54] HAND-MANIPULATABLE THREE-DIMENSIONAL PUZZLE

[76] Inventor: Israel Goldfarb, 206 Bnei Efraim St., Maoz Aviv, Tel-Aviv, Israel

[21] Appl. No.: 415,923

[22] Filed: Sep. 8, 1982

[30] Foreign Application Priority Data

Jan. 22, 1982 [IL] Israel ..... 64833

[51] Int. Cl.[3] ..... A63F 9/08

[52] U.S. Cl. ..... 273/153 S

[58] Field of Search ..... 273/153 S; 434/211

[56] References Cited

U.S. PATENT DOCUMENTS

| | | | |
|---|---|---|---|
| 3,659,360 | 5/1972 | Zeischegg | 273/157 R |
| 4,317,653 | 3/1982 | Wahl | 434/211 |
| 4,344,623 | 8/1982 | Isobe | 273/153 S |

FOREIGN PATENT DOCUMENTS

| | | | |
|---|---|---|---|
| 42695 | 12/1981 | European Pat. Off. | 273/153 S |
| 170062 | 12/1977 | Hungary | 273/153 S |
| 55-8193 | 3/1980 | Japan | 273/153 S |

*Primary Examiner*—Anton O. Oechsle

*Attorney, Agent, or Firm*—Benjamin J. Barish

[57] ABSTRACT

A hand-manipulatable three-dimensional puzzle includes a body in the shape of an octahedron and constituted of a plurality of elements interconnected together to permit rotation of one-half of the body with respect to the other half along each of three orthogonal planes symmetrically passing through the body. In a preferred embodiment, the octahedron-shaped body is defined by a pair of interpenetrating tetrahedra presenting the outline appearance of a six-pointed star whenever the device is viewed along any one of the eight axes of the inter-penetrating tetrahedra.

15 Claims, 19 Drawing Figures

FIG. 1
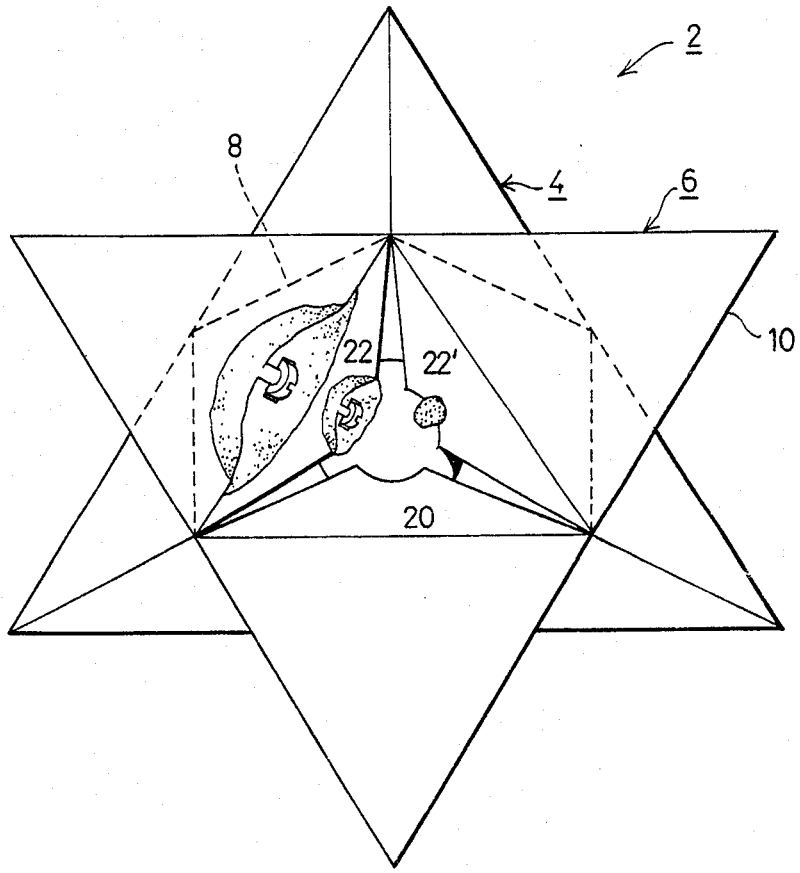
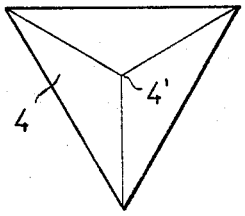
FIG. 2a
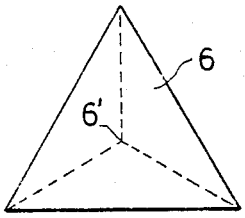
FIG. 2b
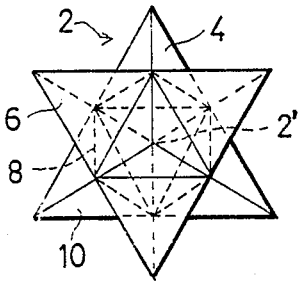
FIG. 2c

FIG.3
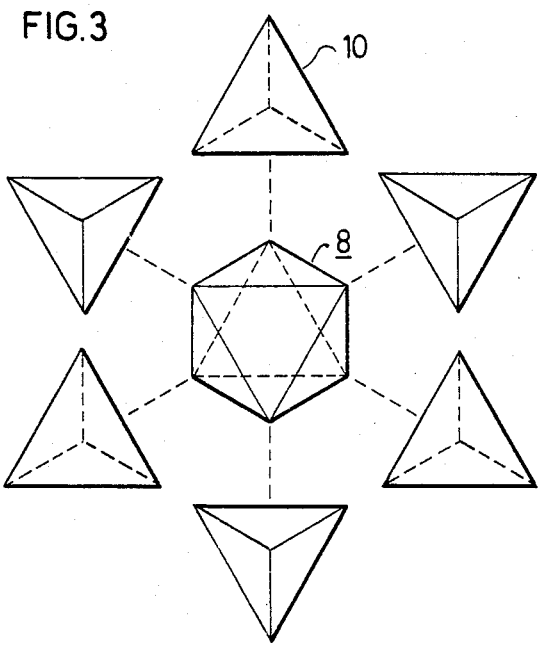
FIG.4a
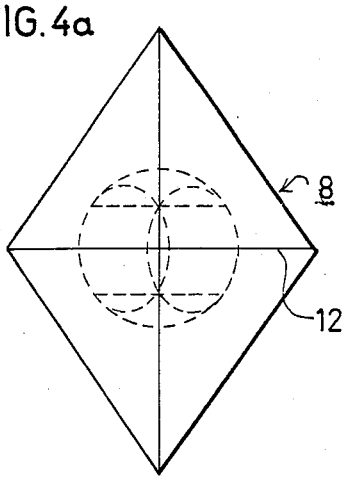
FIG.4b
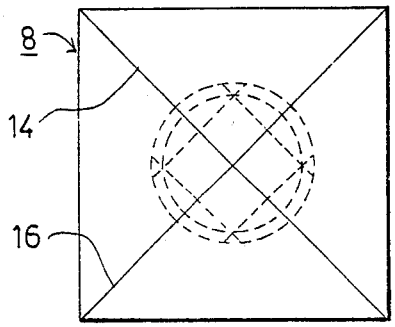
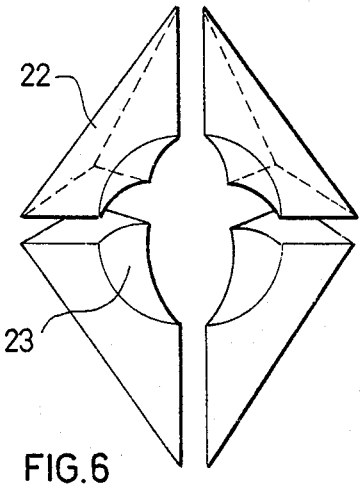
FIG.6
FIG.5
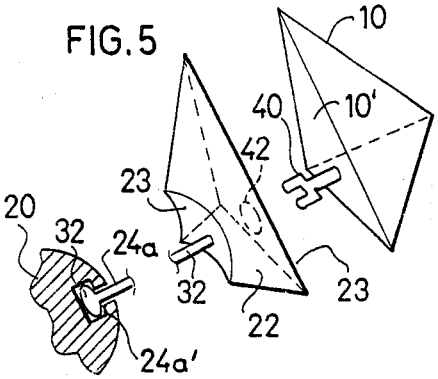

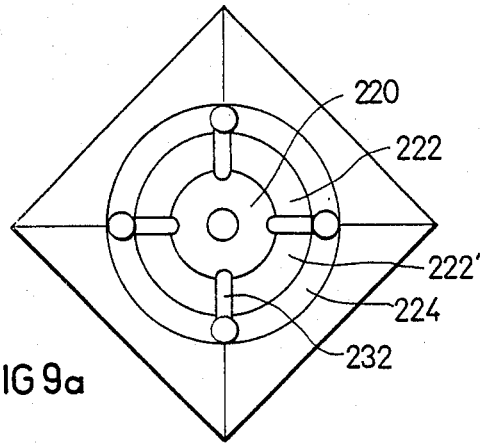
FIG 9a
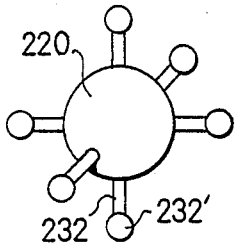
FIG. 9b
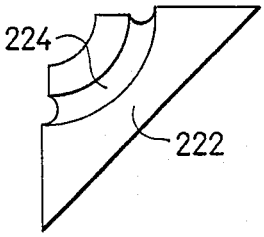
FIG. 9c
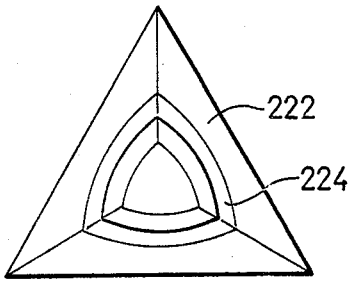
FIG. 9d
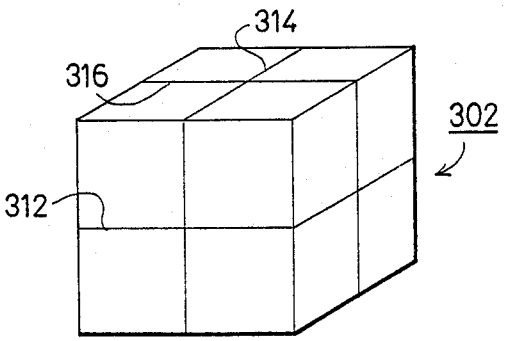
FIG. 10
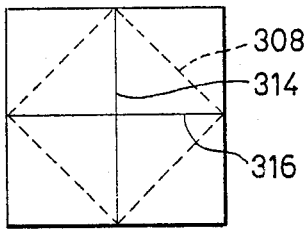
FIG. 10a
FIG. 10b
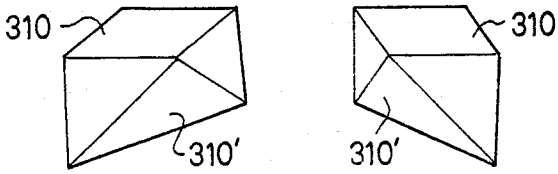

HAND-MANIPULATABLE THREE-DIMENSIONAL PUZZLE

BACKGROUND OF THE INVENTION

The present invention relates to hand-manipulatable, three-dimensional puzzles.

The invention is particularly applicable to the type of puzzle that has recently become popular under the name "Magic Cube", or "Rubik's Cube". This puzzle is in the form of a cube constituted of a plurality of manipulatable cubical elements each including one, two or three facets arranged in a $3\times3\times3$ array such that each face of the cube, consisting of a $3\times3$ array of facets and included in a "slice" constituting one-third of the overall puzzle, may be rotated about the center of the respective face to thereby move the facets to different faces and to different positions on the faces, the object being to reproduce the original pattern of facets on all six faces.

SUMMARY OF THE INVENTION

According to a broad aspect of the present invention, there is provided a hand-manipulatable, three-dimensional puzzle characterized in that it includes a body in the shape of an octahedron and constituted of a plurality of elements interconnected together to permit rotation of one-half of the body with respect to the other half along each of three orthogonal planes symmetrically passing through the body.

The elements constituting said octahedron-shaped body include a center sphere enclosed by eight equilateral, congruent, triangular segments each having a flat, triangular outer face, at least some of which segments are movable along the outer surface of said sphere. More particularly, one of said segments is fixed to the center sphere, and the remaining seven segments are movable over the outer face of said center sphere along three pairs of circular orbits, each pair including two orbits located on opposite sides of the sphere, each of the three pairs of orbits being parallel to one of the three orthogonal planes through the octahedron-shaped body.

The octahedronal shape of the body in the above-described construction is of particular significance. Thus, the octahedron is one of the five regular polyhedral shapes in which each face is of the same identical configuration. The octahedron has eight congruent, equilateral, triangular faces, which fact permits the various faces to be interchanged by rotation of a portion of the puzzle with respect to another portion, as in the case of the "Magic Cube", the latter having a hexahedral (cubic) configuration. The octahedron is also characterized by having three planes of symmetry parallel to the three orthogonal planes (i.e., X, Y and Z planes) passing through the device, thereby permitting one-half of the device to be rotated with respect to the other half along each of these three orthogonal planes of symmetry, to move the faces of the octahedron to different locations thereon.

One embodiment of the invention is described below, wherein each of said triangular segments carries an outer element having a congruent triangular base. Each of said outer elements is in the shape of a tetrahedron having its vertex directed outwardly, whereby said outer elements define with said octahedron-shaped body, a pair of inter-penetrating tetrahedra presenting the outline appearance of a six-pointed star whenever the device is viewed along any axis extending through the vertex of each of the eight outer tetrahedra.

When the invention is embodied in this form, one-half of the device may be rotated along any one of the three symmetrical planes with respect to the other half, thereby permitting the eight smaller tetrahedra, and particularly the three outer faces of each, to be moved to different parts of the device, and to different positions on each part. The eight smaller tetrahedra, which define the outer face of the puzzle, may thus be manipulated to different positions in an attempt to reproduce the predetermined pattern defining the ultimate solution of the puzzle.

Each face of the two inter-penetrating large tetrahedra has a distinctive visual appearance, e.g., of different colors.

Another embodiment of the invention is described below, wherein each of said outer elements is of a truncated cubical shape corresponding to that produced when one corner of a cube has been cut-off along an inclined plane defining a triangular face congruent to that of its triangular segments, whereby the outer elements define, with said octahedron-shaped body, a cube in which each of its six faces includes four facets constituted of said outer elements, each of which elements includes three facets, one in each of the three orthogonal planes.

Further features of the invention will be apparent from the description below.

BRIEF DESCRIPTION OF THE DRAWINGS

The invention is herein described, by way of example only, with reference to the accompanying drawings, wherein:

FIG. 1 is a front view, partly broken away to show internal structure, illustrating one form of puzzle device constructed in accordance with the present invention;

FIG. 2*c* illustrates the configuration of FIG. 1 and how it is constituted of the two tetrahedra illustrated in FIGS. 2*a* and 2*b* respectively, these figures being helpful in explaining the construction and advantages of the FIG. 1 form of the invention;

FIG. 3 is an exploded view illustrating the inner octahedron and the smaller tetrahedra (only six of the eight being shown) provided by the configuration of the invention illustrated in FIGS. 1 and 2;

FIGS. 4*a* and 4*b* are side and top views, respectively, of the inner octahedron in FIG. 3;

FIG. 5 is a fragmentary exploded view illustrating the construction of the inner octahedron of FIGS. 3, 4*a* and 4*b*, and the manner of securing one of the outer smaller tetrahedra to each face of the inner octahedron;

FIG. 6 illustrates the construction of the segments constituting the outer structure of the inner octahedron;

FIGS. 9*a*–9*d* illustrate another variation in the structure; and

FIG. 10 illustrates another configuration of a puzzle constructed in accordance with the invention, FIG. 10*a* being a top view of FIG. 10, and FIG. 10*b* illustrating the configuration of the outer elements.

DESCRIPTION OF PREFERRED EMBODIMENTS

Figure 7A:
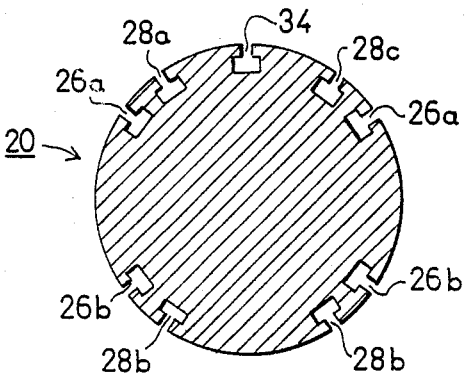
FIG. 7 illustrates the center sphere disposed within the octahedron of FIGS. 3, 4*a* and 4*b*, FIG. 7*a* being a sectional view along lines a—a of FIG. 7.

With reference first to FIG. 1, there is illustrated one form of hand-manipulatable three-dimensional puzzle generally designated 2, whose overall configuration is defined by two inter-penetrating tetrahedra, designated 4 and 6 respectively. The outer configuration of puzzle 2 will be better understood by reference to FIG. 2*c* illustrating the same configuration as in FIG. 1, but of reduced scale, and to FIGS. 2*a* and 2*b* illustrating the two tetrahedra, 4 and 6 respectively, which are combined together in inter-penetrating relationship to produce the outer configuration of the puzzle. Thus, to produce this outer configuration, tetrahedron 4, having center 4', is combined in inversely-related, inter-penetrating relationship with tetrahedron 6, having its center 6' at the same point as center 4' of tetrahedron 4. This combination produces the geometric configuration illustrated for puzzle 2, whose center 2' is at the same point as centers 4' and 6' of the two tetrahedra 4 and 6.

It will be seen that the geometric configuration of puzzle 2 formed by this combination includes an inner octahedron, shown by broken lines 8 in FIGS. 1 and 2*c*, having eight congruent, equilateral, triangular faces each occupied by one of eight smaller tetrahedra, and each designated 10 in FIGS. 1 and 2*c*, the base of each of the eight smaller tetrahedra 10 being of the same triangular configuration as the outer face of the inner octahedron 8.

Of particular interest in such a geometric configuration, as indicated earlier, is that is presents the outline appearance of a six-pointed star whenever the device 2 is viewed along any one of the eight lines extending through the vertex of one of the smaller tetrahedra 10. Also of interest in this configuration and particularly in this construction based on the provision of the inner octahedron 8, is that one-half of the puzzle 2 may be rotated along any one of the three symmetrical orthogonal planes with respect to the other half, thereby permitting the eight smaller tetrahedra 10, and particularly the three outer faces of each, to be moved to different parts of the device and to different positions of each part. Thus, by providing the eight faces of the two larger, inter-penetrating tetrahedra 4 and 6 with different colors (or with other means for visually distinguishing one face from the other), each of the eight smaller tetrahedra 10 will expose three faces of different colors, which faces may be manipulated to different positions of the device in an attempt to reproduce the original color pattern defining the ultimate solution of the puzzle.

The inner octahedron 8 is more particularly illustrated in FIGS. 3, 4*a* and 4*b*. FIG. 3 also illustrates six of the eight tetrahedra 10 occupying the eight congruent triangular faces of the octahedron 8; and the top and side views of FIGS. 4*a* and 4*b*, respectively, show particularly the three symmetrical planes of movement 12, 14 and 16 through the octahedron 8, and, therefore, through the complete geometrical body constituting the puzzle 2. Thus, one-half of the puzzle, including four of the smaller tetrahedra 10, will always be moved together with respect to the other half containing the remaining four tetrahedra 10 whenever a manipulation is made along any one of the three planes of movement 12, 14 or 16.

For permitting these manipulations, the inner octahedron 8 includes a center sphere 20 enclosed by eight congruent, equilateral, triangular segments 22 each having a flat, triangular outer face. One of the segments 22 is fixed to the center sphere 20 as shown by segment 22' in FIG. 1, and the other seven segments 20 are movable along the outer face of sphere 20 along six circular orbits of equal radii. These orbits, as shown particularly in FIGS. 7 and 7*a*, consist of a first pair of grooves 24*a*, 24*b* in planes parallel to one orthogonal plane on opposite sides of the sphere center 20; a second pair of grooves 26*a*, 26*b* in planes parallel to a second orthogonal plane and on opposite sides of the sphere center; and a third pair of grooves 28*a*, 28*b* in planes parallel to the third orthogonal plane and also on opposite sides of the sphere center.

Figure 7:
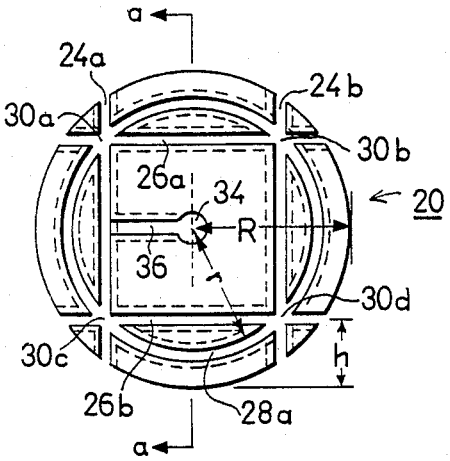

As shown in FIG. 7, the grooves defining these six orbits intersect each other at eight intersection points. Four of these are seen in FIG. 7, therein indicated as 30*a*, 30*b*, 30*c* and 30*d*, it being appreciated that the other four are on the opposite (unseen) side of sphere 20. It will also be seen from FIG. 7 that three of the orbits, one of each of the three pairs, intersect each other at each of these eight intersection points.

The radius (r) of each of the six grooves defining the six orbits formed in the outer face of sphere 20 is related to the radius (R) of the sphere 20, and also to the spacing (h) of each orbit inwardly of the outer face of the sphere 20, according to the following relationships:

$$r = \sqrt{2Rh - h^2} \quad (1)$$

$$r = \sqrt{2(R - h)^2} \quad (2)$$

Each of the triangular segments 22 covering the outer face of sphere 20 is formed with a pin 32 receivable in the grooves defining the above-mentioned six orbits. Pin 32 is enlarged at its tip, as shown at 32', and each groove of the six orbits is correspondingly enlarged, as shown at 24*a'* in FIG. 5, so that each pin 32 constrains the movement of its respective triangular segment only to the abovementioned orbits in sphere 20, and prevents the removal of the segments from the sphere.

For purposes of initially assembling the triangular segments 22 over the sphere 20, the latter is formed with an enlarged circular opening, as shown at 34 in FIG. 7, to permit the insertion of the enlarged head 32' of each segment pin 32. Sphere 20 is also formed with a groove 36 to permit moving the respective segment to one of the orbital grooves, whereupon it may be manipulated over the face of the sphere 20 as will be described more particularly below.

The inner face of each of the triangular segments 22 is formed with a spherical concavity, as shown at 23 in FIGS. 5 and 6, to conform to the outer spherical face of sphere 20. The outer face 23' of each triangular segment is flat to conform to the flat face 10' at the base of the respective smaller tetrahedron 10.

Each small tetrahedron 10 occupying the outer face of each of the eight triangular segments 22 may be rotatably mounted to its respective segment. Thus, as shown in FIG. 5, the base or inner face 10' of the tetrahedron 10 is formed with a pin 40 receivable in a hole 42 formed in the outer face of the respective triangular segment 22, the end of pin 40 being enlarged so as to be received with a snap-fit into hole 42.

Each of the eight faces of the two large, interpenetrating tetrahedra 4 and 6 illustrated in FIGS. 2*a* and 2*b* has a distinctive visual appearance from all the other faces. For example, each face may be of a distinctive color, so that eight different colors would be required for the complete puzzle 2 illustrated in FIGS. 1 and 2. Since each of the eight smaller tetrahedra 10 exposes three faces (or facelets) to view, it will be seen that each of the three exposed faces of the eight tetrahedra 10 would be of a different color, corresponding to the colors of the three meeting faces at the vertices of the respective large tetrahedron 4 or 6.

The illustrated three-dimensional puzzle would be assembled as described above, with the pins 32 of the eight triangular segments 22 received within the grooves defining the six orbits on the outer face of sphere 20, and with the pins 40 of the eight smaller tetrahedra 10 received in the holes 42 in the outer faces of the triangular segments 22. Four of the eight tetrahedra may be manipulated as a unit with respect to the remaining four along any one of the three symmetrical planes (12, 14 or 16) of the inner octahedron 8, as described above, this manipulation being permitted by the movement of the segment pins 32 within the grooves defining the six orbits on the outer face of sphere 20. The eight segment pins 32 would normally be located at the eight intersection points (e.g. 30*a*–30*d*, FIG. 7) of the six orbital grooves, thereby permitting this manipulation of segments 22, including their respective smaller tetrahedra 10, along any one of the three symmetrical planes 12, 14, 16 at these intersection points.

Thus, by manipulating one-half of the puzzle, including four of the smaller tetrahedra 10 in any one of these three directions with respect to the other half including the remaining four tetrahedra, and by rotating the tetrahedra 10 on their respective segments 22, the tetrahedra 10 can be manipulated to occupy different locations, and also different facings or positions, with respect to each other. The solution of the puzzle would result whenever these tetrahedra are manipulated to reproduce the original distinctive color arrangement of the eight faces of the large polyhedra 4, 6, as described above.

Having each of the smaller tetrahedra rotatably mounted on the outer face of its respective triangular segment 22 adds greatly to the number of possible permutations and combinations. Each of the eight tetrahedra 10, however, may be integrally formed with, or otherwise fixedly mounted to, the respective triangular segment 22, if it is desired to provide a simpler puzzle with a decreased number of possible permutations and combinations.

Figure 8:
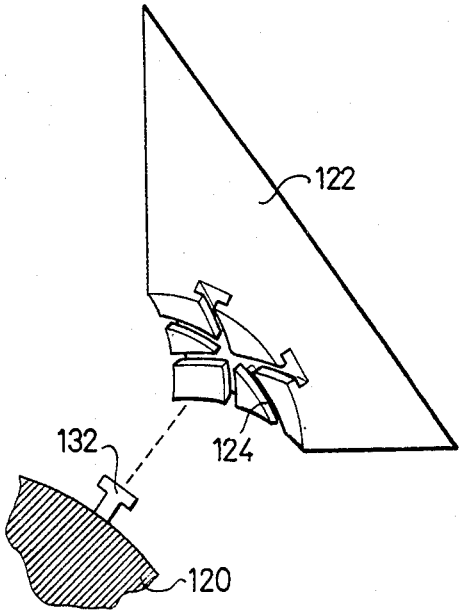
FIG. 8 is a fragmentary three-dimensional view illustrating one variation in the structure.

It will be appreciated that many other variations in the puzzle can be made. FIG. 8 illustrates one such variation, wherein the six orbits on the outer face of the sphere, designated 120 in FIG. 8, are defined by pins 132 fixed to the outer face of the sphere, which pins are receivable in grooves 124 formed in the inner face of the triangular segments 122.

FIGS. 9*a*–9*d* illustrate another variation wherein the central sphere 220 is also formed with pins 232 defining the six orbits, but here the pins, i.e., their enlarged heads 232′, are movable within complementary grooves formed between two confronting faces of the triangular segments 222. Thus, as in the case of both of the earlier-described arrangements, one of the segments (designated 222′ in FIG. 9*a*) would be fixed to the center sphere 220, whereas all the other segments would be movable with respect to the center sphere along any one of the three orthogonal planes in the same manner as described above except that in the FIGS. 9*a*–9*d* embodiment the grooves within which the pins move are complementary grooves formed in the confronting side faces of the triangular segments rather than in their inner faces as in the FIG. 8 embodiment. An advantage in the arrangement illustrated in FIGS. 9*a*–9*d* is that it simplifies the manufacture of the device.

Another variation is illustrated in FIGS. 10, 10*a* and 10*b*. In this variation, the outer shape of the overall puzzle, generally designated 302 in FIG. 10, is made to be of cubical configuration, rather than of the two interpenetrating tetrahedra configuration previously described.

Thus, puzzle 302 includes the inner octahedron, shown by broken lines 308 in FIG. 10*a*, corresponding in configuration and construction to the inner octahedron 8 in the embodiment of FIGS. 1–7, including a center sphere (20) and triangular segments (22) movable along its outer surface, to permit one-half of the octahedron 308 to be rotated along each of the three orthogonal planes of symmetry, designated 312, 314 and 316, respectively, in FIGS. 10 and 10*a*. It also includes the outer elements 310 carried by each of the eight outer faces of the octahedron 308. However, instead of configuring these outer elements in the shape of smaller tetrahedra (corresponding to tetrahedra 10 in FIGS. 1–7), these outer elements 310 are formed according to a truncated cubical configuration, best seen in FIG. 10*b*; that is, they are of the configuration of a cube but wherein one corner has been cut off by an inclined plane extending through the three corners enclosing the cut-off corner, to thereby produce a triangular face 310′ of identical shape and dimension so as to mate with the eight triangular faces of the octahedron 308. Only two of these outer elements 310 are illustrated in FIG. 10*b*, but it will be appreciated that when all eight of the triangular faces of the inner octahedron 208 are occupied by such outer elements, the overall outer appearance of the device will be cubical, as shown in FIG. 10.

The construction and manner of rotation of the inner octahedron 308, and the manner of mounting the outer elements 310 to it, may otherwise be the same as described above with respect to the FIGS. 1–7 embodiment, and are therefore not illustrated in this FIG. 10 embodiment.

It is also contemplated that a puzzle could be provided with two sets of outer elements, one set corresponding to the tetrahedra configuration of elements 10 in the FIGS. 1–7 embodiment, and the other set conforming to the truncated cube configuration of elements 310 in the FIG. 10 embodiment, so that a puzzle may be selectively assembled according to either of the two described configurations.

In addition, while the invention has been described with respect to a center octahedron configuration, in which one-half may be rotated with respect to the other half in any one of the three orthogonal planes, it will be appreciated that the invention, and particularly the arrangement including the center sphere defining the orbits for the movement of the segments can be used with respect to other arrangements and configurations.

It will be appreciated that many other variations, modifications and applications of the invention may be made.

What is claimed is:

1. A hand-manipulatable three-dimensional puzzle characterized in that it includes a body in the shape of an octahedron and constituted of a plurality of elements interconnected together to permit rotation of one-half of the body with respect to the other half along each of three orthogonal planes symmetrically passing through the body, said elements constituting said octahedron-shaped body including a center sphere enclosed by eight equilateral, congruent, triangular segments having flat triangular outer faces, seven of which segments are movable along the outer surface of said sphere, the eighth segment being fixed to said sphere; each of said triangular segments carrying an outer element in the shape of a tetrahedron having its vertex directed outwardly, whereby said outer elements define with said octahedron-shaped body, a pair of inter-penetrating tetraheadra presenting the outline appearance of a six-pointed star whenever the device is viewed along any axis extending through the vertex of each of the eight outer tetrahedra.

2. The puzzle according to claim 1, wherein said seven segments are movable over the outer face of said center sphere along three pairs of circular orbits, each pair including two orbits located on opposite sides of the sphere, each of the three pairs or orbits being parallel to one of the three orthogonal planes through the octahedron-shaped body.

3. The puzzle according to claim 2, wherein the radius (r) of each of said circular orbits has the following relationship with respect to the radius (R) of the center sphere and to the spacing (h) of each orbit inwardly of the outer face of the sphere:

$$r = \sqrt{2Rh - h^2} \quad \text{(a)}$$

$$r = \sqrt{2(R - h)^2}\ . \quad \text{(b)}$$

4. A puzzle according to claim 2, wherein said center sphere is formed with grooves defining said circular orbits, and said triangular segments include pins received in said grooves.

5. The puzzle according to claim 2, wherein said center sphere is formed with pins defining said circular orbits and said triangular segments include grooves receiving said pins.

6. The puzzle according to claim 5, wherein said grooves in said triangular segments are formed on the inner faces of said triangular segments.

7. The puzzle according to claim 5, wherein said grooves in said triangular segments are formed in the confronting side faces of said triangular segments.

8. The puzzle according to claim 1, wherein at lease seven of said outer tetrahedra are rotatably mounted about their axes to their respective triangular segments.

9. The puzzle according to claim 1, wherein all of said outer tetrahedra are fixed to their respective triangular segments.

10. The puzzle according to claim 1, wherein each face of the two inter-penetrating tetrahedra has a distinctive visual appearance from the other faces.

11. The puzzle according to claim 10, wherein each face of the two inter-penetrating tetrahedra is of a different color from the other faces.

12. A hand-manipulatable, three-dimensional puzzle including a center sphere enclosed by eight segments, one of said segments being fixed to said sphere and the others being movable over its outer face along a plurality of orbits including at least one orbit for each of three orthogonal planes, each of said plurality of segments being of congruent triangular shape and having an outer flat triangular face, all said pluality of segments together defining an octahedron-shaped body; each of said triangular segments carrying an outer element in the shape of a tetrahedron having its vertex directed outwardly, whereby said outer elements define with said octahedron-shaped body, a pair of inter-penetrating tetrahedra presenting the outline appearance of a six-pointed star whenever the device is viewed along any axis extending through the vertex of each of the eight outer tetrahedra.

13. The puzzle according to claim 12, wherein said orbits include a plurality of pairs of orbits, each pair including two orbits located on opposite sides of the sphere; and each of the plurality of pairs of orbits being parallel to one of the three orthogonal planes through the sphere.

14. A puzzle according to claim 12, wherein said center sphere is formed with grooves defining said circular orbits, and said segments include pins received in said grooves.

15. A puzzle according to claim 12, wherein said center sphere is formed with pins defining said circular orbits, and said segments include grooves receiving said pins.

* * * * *